US007303349B2

(12) United States Patent
Murakoshi

(10) Patent No.: US 7,303,349 B2
(45) Date of Patent: Dec. 4, 2007

(54) PEN ADAPTED TO BE PRESSURIZED

(75) Inventor: Yasuo Murakoshi, Saitama (JP)

(73) Assignee: Tombow Pencil Co., Ltd., Tokyo (JP)

( * ) Notice: Subject to any disclaimer, the term of this patent is extended or adjusted under 35 U.S.C. 154(b) by 0 days.

(21) Appl. No.: 11/604,419

(22) Filed: Nov. 27, 2006

(65) Prior Publication Data

US 2007/0127976 A1 Jun. 7, 2007

(30) Foreign Application Priority Data

Dec. 5, 2005 (JP) ..... 2005-351065

(51) Int. Cl.
*A46B 11/02* (2006.01)

(52) U.S. Cl. ..... 401/188 A; 401/188 R

(58) Field of Classification Search ..... 401/188 R, 401/188 A, 143
See application file for complete search history.

(56) References Cited

U.S. PATENT DOCUMENTS 7,128,491 B2 * 10/2006 Kobayashi ..... 401/188 A

* cited by examiner

*Primary Examiner*—David J. Walczak
(74) *Attorney, Agent, or Firm*—Scott D. Wofsy; Edwards Angell Palmer & Dodge LLP

(57) ABSTRACT a pen adapted to be pressurized and capable of being manufactured inexpensively, with which ink can be smoothly supplied and an excessive pressurization within an ink accommodating tube and the leakage of ink can be prevented, as well as a pen that can be easily used in a state that a pen tip is directed upwardly. The pen comprises a pressurizing pump mechanism 10 which pressurizes an inside of ink accommodating tube 3 and includes a pressurizing chamber 14 communicating with the inside of the ink accommodating tube, an elastic spherical body 16 disposed to be pushed into the pressurizing chamber, a compression spring 17 that urges the spherical body in a direction to be released from within the pressurizing chamber, and a pressing stem 18 that moves the spherical body against the urging force of the compression spring into the pressurizing chamber in an airtight state.

9 Claims, 3 Drawing Sheets

PEN ADAPTED TO BE PRESSURIZED

BACKGROUND OF THE INVENTION

1. Field of the Invention

The present invention relates to a pen, for example, a ballpoint pen, a correction pen, a sizing pen, and particularly to a pen adapted to be pressurized (hereinafter pressurization pen), which is capable of smoothly supplying a medium such as ink, correction fluid, paste, etc., when using the pen.

2. Description of the Related Art

The known pen, for example, a ballpoint pen has been experienced a disadvantage that ink does not smoothly outflow from a pen tip of a pen refill unit in use or ink is interrupted during writing, so that when such problem is occurred, it is necessary to scrub the pen tip on a paper to outflow the ink.

To overcome such disadvantage, as disclosed in Japanese Patent Publication JP-A-2004-268567 (FIGS. 3 and 4) and Japanese Patent Publication JP-A-2005-178304 (FIGS. 3 and 4), it has been suggested that a pen refill unit of a ballpoint pen is provided with a pressurizing pump mechanism and an inside of ink accommodating tube filled with ink is pressurized through the operation of the pressurizing pump mechanism in the related art.

However, in the known ballpoint pen of any of above described patent documents, the inside of the ink accommodating tube is sealed to maintain always the pressurized state after the inside of the ink accommodating tube of a pen refill unit is pressurized by the pressurizing pump mechanism. In this state, when the pressurizing pump mechanism is repeatedly operated, the inside of the ink accommodating tube becomes an excessive pressurized state so that the ink leakage may easily occur to contaminate a pen holder, and hence hands or clothes. In addition, there is further disadvantage that in order to maintain the inside of the ink accommodating tube in a high airtight state, materials of seal parts and the processing precision are required, thereby increasing a cost.

SUMMARY OF THE INVENTION

An object of the invention is to provide an improved pressurization pen. More specifically it is an object of the invention to provide a pressurization pen capable of being manufactured with low cost, with which a medium such as ink, a correction fluid, a paste can be smoothly supplied and an excessive pressurization within a tube accommodating the medium and a leakage of the medium can be prevented. Still another object of the invention is to provide a pressurization pen which can be easily used in a state that a pen tip is directed upwardly.

According to one aspect of the invention there is provided:

(1) A pen adapted to be pressurized including:

an axial housing having front and rear ends;

a pen refill unit mounted within said axial housing and including a tube for accommodating a medium like ink etc. said tube having front and rear ends;

a pen tip provided at the front end of said tube and protruding to the outside from the front end of the axial housing in a fixed state, and a pressurizing pump mechanism provided at the rear end of said medium accommodating tube for pressurizing the inside thereof, said pressurizing pump mechanism including a pressurizing chamber communicating with the inside of the medium accommodating tube, an elastic body adapted to be pushed into the pressurizing chamber, an urging unit for urging said elastic body in a releasing direction to be released from within the pressurizing chamber, and a pressing unit for moving forcedly the elastic body in a direction opposite the releasing direction against the urging force of the urging unit for pushing said elastic body into the pressurizing chamber in an airtight state, whereby the inside of the medium accommodating tube being pressurized when said elastic body is pushed by an operation of the pressing unit into the pressurizing chamber against the urging force of the urging unit, and the elastic body is released from within the pressurizing chamber by the urging force of the urging unit in a pushing-release operation of the pressing unit to maintain the inside of the medium accommodating tube in a state ventilated with ambient air.

In a modified embodiment of the invention there can be provided: a knock mechanism for projecting said pen tip to the outside of the axial housing and for retracting it into the axial housing. The knock mechanism may comprise a rotary member driven by a cam mechanism through the push and release operation of a knock stem for retracting and projecting said pen tip of the pen refill unit into or from the axial housing, respectively, in which the pressing unit is coupled to the rotary member to be pushed and held in the projected state of the pen tip to maintain the inside of the medium accommodating tube in a pressurized state, while in a retracted state of the pen tip, the inside of the medium accommodating tube is maintained in a state ventilated with ambient air.

Preferably the pen further includes a cap adapted to be mounted in removable manner in a first position at the front end of the axial housing for protecting the pen tip of the pen refill unit, and at the rear end of the axial housing in a second position for pushing and holding the pressing unit, thereby maintaining the inside of the medium accommodating tube in a pressurized state.

By the invention, the following effects are obtained:

Since the inside of the ink accommodating tube is pressurized and subsequently ventilated to the ambient air through a single push and release operation of the pressing unit, the medium like ink etc. can be smoothly supplied and an excessive pressurization within the medium accommodating tube and leakage of the medium be prevented. Furthermore the pen can be used in a state that the pen tip is directed upwardly. Since an elastic body which can easily be deformed is used, a specific manufacturing precision is not required so that it is possible to manufacture the pen with low costs. The elastic body preferably is formed as spherical body. Thereby it is deformed elastically upon pressurizing to be pushed into the pressurizing chamber and the pressurization can be smoothly performed and the elastic deformation in an axial direction is relatively large. Therefore, the pressurization by a single stroke pushing of the pressing unit becomes larger and the pressurization efficiency can be increased. Since the rear end of the axial housing is covered with the cap in use of the pen to easily maintain the pressurized state, it is effective particularly in preventing the interruption of ink when the pen is used in a state that the pen tip is directed upwardly.

Since the pressing unit is automatically pushed by the pushing operation of the knock stem in use of the pen to maintain the pressurized state, it is effective particularly in preventing the interruption of ink when the pen is used in a state that the pen tip is directed upwardly.

The accompanying drawings which are incorporated in and constitute part of the present specification, are included to illustrate and provide for a further understanding of the invention.

DESCRIPTION OF PREFERRED EMBODIMENTS OF THE INVENTION

Figure 1:
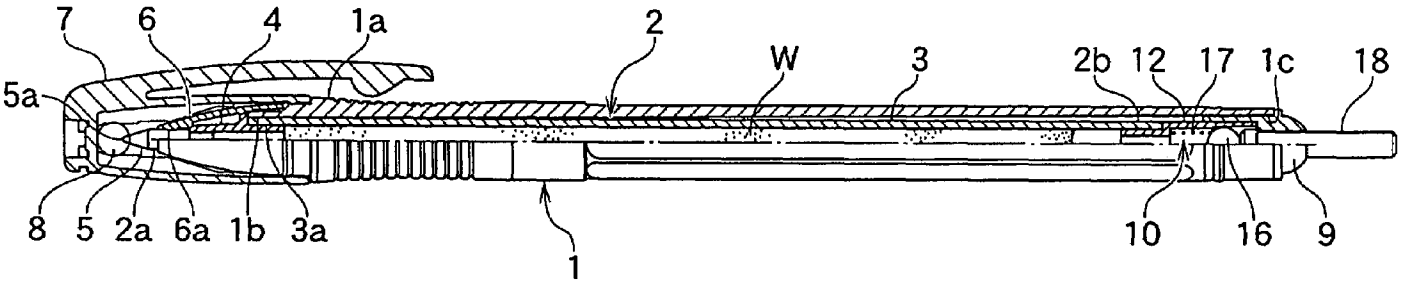
FIG. 1 is a partly cross sectional view showing a pressurization pen according to a first embodiment of the invention.
Figure 2:
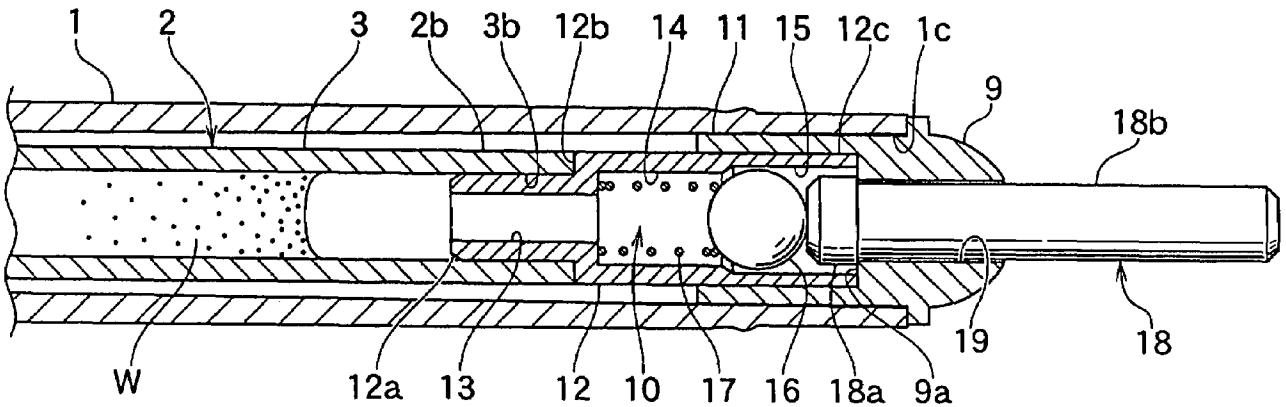
FIG. 2 is an enlarged cross sectional fragmentary view showing a pressurizing pump mechanism of the pressurization pen shown in FIG. 1 in a non-pressurized state when the pen is not in use.
Figure 3:
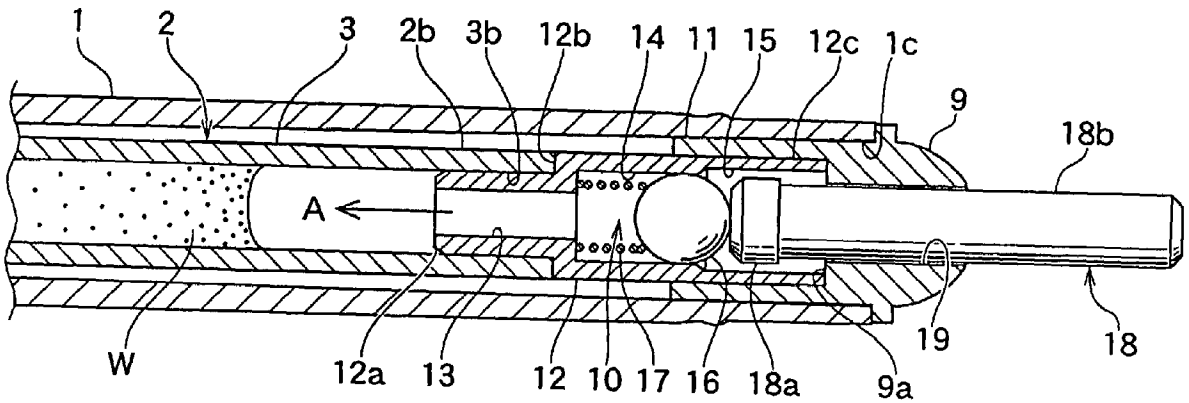
FIG. 3 is a view similar to FIG. 2 of the pressurizing pump mechanism when the pen is in use.

Hereinafter, preferred embodiments of the invention will be described in detail with respect to a ballpoint pen as an example. FIG. 1 is a half cross sectional view illustrating a pressurization pen according to a first embodiment of the invention. FIG. 2 is an enlarged cross sectional view of main parts illustrating a pressurizing pump mechanism in a non-pressurized state when the pen is not used. FIG. 3 is an enlarged cross sectional view of main parts in a pressurized state when the pen is used. In the figures, with respect to a paper, 'left side' is referred to as 'front' and 'right side' is referred to as 'rear'.

As shown in FIG. 1, a ballpoint pen in accordance with of the first embodiment of the invention has an axial housing 1, and a pen refill unit 2 mounted within the axial housing 2 in a fixed state. The pen refill unit 2 includes an ink accommodating tube 3 having ink W filled therein as a writing medium, and a pen tip 5 mounted at a front end 3*a* of the ink accommodating tube 3 by means of a joint member 4. The pen tip 5 faces to the outside through an opening 6*a* of a pen tip member 6 disposed in a front end 1*a* of an opening 1*b* of the axial housing 1. A front end 2*a* of the pen refill unit 2 is held by the pen tip member 6 and the joint member 4.

The front end 1*a* of the axial housing 1 is covered with a cap 7 having a clip, and an inner ball 8 formed of an elastic spherical body is provided within the cap 7. The front end 5*a* of the pen tip 5 is protected by the inner ball 8 when the pen is not used. A rear opening 1*c* of the axial housing 1 is blocked by a tail plug 9.

A pressurizing pump mechanism 10 is mounted on a rear end 2*b* of the pen refill unit 2. As shown in FIG. 2, the pressurizing pump mechanism 10 has a cylindrical guide bush 12 fixed in an inner peripheral surface of the rear opening 1*c* of the axial housing 1 via a fixing annular portion 11 of the tail plug 9. The guide bush 12 is decreased in diameter via a stepped portion 12*b* such that an outer periphery of a front end 12*a* has a small diameter and is pushed into a rear opening 3*b* of the ink accommodating tube. The stepped portion 12*b* of the guide bush 12 is abutted in an airtight state and a rear end 12*c* of the guide bush 12 is fitted into the fixing annular portion 11 of the tail plug 9.

The inside of the guide bush 12 is increased in diameter in three steps from the front end 12*a* towards the rear end 12*c* to form a ventilation passage 13, a pressurizing chamber 14 and a spherical body accommodating portion 15 sequentially and communicates with the inside of the ink accommodating tube 3. A spherical body 16 is accommodated within the spherical body accommodating portion 15 and is formed of elastic materials which can be easily be deformed such as silicon rubber or a butyl rubber having gas barrier property in hollow or solid configuration either as a true spherical or an elliptically spherical shape. A diameter of the spherical body 16 is slightly smaller than an inner diameter of the spherical body accommodating portion 15 and is larger than an inner diameter of the pressurizing chamber 14 so that the spherical body can be pushed into the pressurizing chamber 14 by being deformed elastically.

A compression spring 17 as urging means is disposed within the pressurizing chamber 14 and is urged in a direction to release the spherical body 16 from the pressurizing chamber 14, that is, toward the rear.

A pressing stem 18 as pressing means is provided within the spherical body accommodating portion 15 from the rear toward the front, and a front end large-diameter portion 18*a* of the pressing stem 18 can push and move the spherical body 16 towards the pressurizing chamber 14. A rear end small-diameter portion 18*b* of the pressing stem 18 is inserted into a ventilation hole 19 formed through the tail plug 9 and the rear end thereof is protruded to the outside. The pressing stem 18 is assembled from the inside of the tail plug 9, and the front end large-diameter portion 18*a* is latched to a front end peripheral edge 9*a* of the ventilation hole 19 of the tail plug 9.

Next, an operation of the pressurizing pump mechanism 10 according to the embodiment will be explained. As shown in FIG. 2, in non-use state, the spherical body 16 is released from the pressurizing chamber 14 to be positioned within the spherical body accommodating portion 15 by the urging force of the compression spring 17, and the inside of the ink accommodating tube 3, the ventilation passage 13, the pressurizing chamber 14 and the spherical body accommodating portion 15 are in a state ventilating with an ambient air through the ventilation hole 19 of the tail plug 9. The inside of the ink accommodating tube 3 is in a non-pressurized state.

As shown in FIG. 3, in a pen use state, if the pressing stem 18 is pushed toward the front, the spherical body 16 moves towards and is pushed into the inside of the pressurizing chamber 14 while being deformed elastically against the urging force of the compression spring 17 to form the airtight state within the pressurizing chamber 14. An air A within the pressurizing chamber 14 is forcedly transported within the ink accommodating tube 3 through the ventilation passage 13 in accordance with the moved distance of the spherical body 16 as indicated by an arrow. Whereby, the pressurized state is formed within the ink accommodating tube 3 and since the elastic deformation of the spherical body 16 at that time is large, the pressurized amount is large and the pressurization efficiency can be increased.

In a pressurized state that the pressing stem 18 is pushed shown in FIG. 3, if the pushing operation of the pressing stem 18 is stopped, the pressing stem 18 moves towards the rear together with the spherical body 16 by the urging force of the compression spring 17 and the spherical body 16 is released from within the pressurizing chamber 14 to be returned to an original position shown in FIG. 2. Again, the inside of the ink accommodating tube 3, the ventilation passage 13, the pressurizing chamber 14 and the spherical body accommodating portion 15 become a state ventilating with an ambient air through the ventilation hole 19 of the tail plug 9, and the pressurized state within the ink accommodating tube 3 is released. As such, since the inside of the ink accommodating tube 3 is pressurized and subsequently ventilated to the ambient air through the single push and release operation by the pressing stem 18, the ink W can be smoothly supplied and the excessive pressurization within the ink accommodating tube 3 can be obviated so that the leakage of the ink can be prevented.

Figure 4:
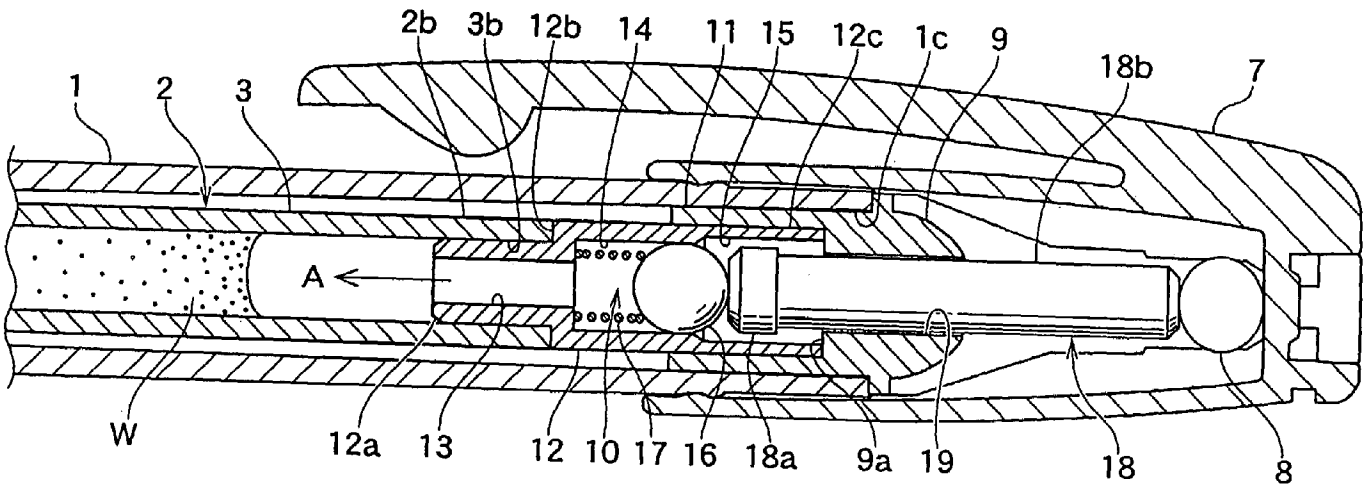
FIG. 4 is an enlarged cross sectional fragmentary view illustrating modified usage of the pressurization pen according to the invention.

FIG. 4 is an enlarged cross sectional view of main parts illustrating the other usage of the invention. In pen use state, when the cap 7 covered on the front end 1*a* of the axial housing 1 (refer to FIG. 1) is removed and covered on the rear end opening 1*c* of the axial housing 1, the inner ball 8 provided within the cap 7 pushes the pressing stem 18 of the pressurizing pump mechanism 10 and holds the pushed state, so that the pressurized state within the ink accommodating tube 3 can be maintained. Therefore, it is effective particularly in preventing the interruption of the ink when the pen is used in a state that the pen tip is directed upwardly.

Figure 5:
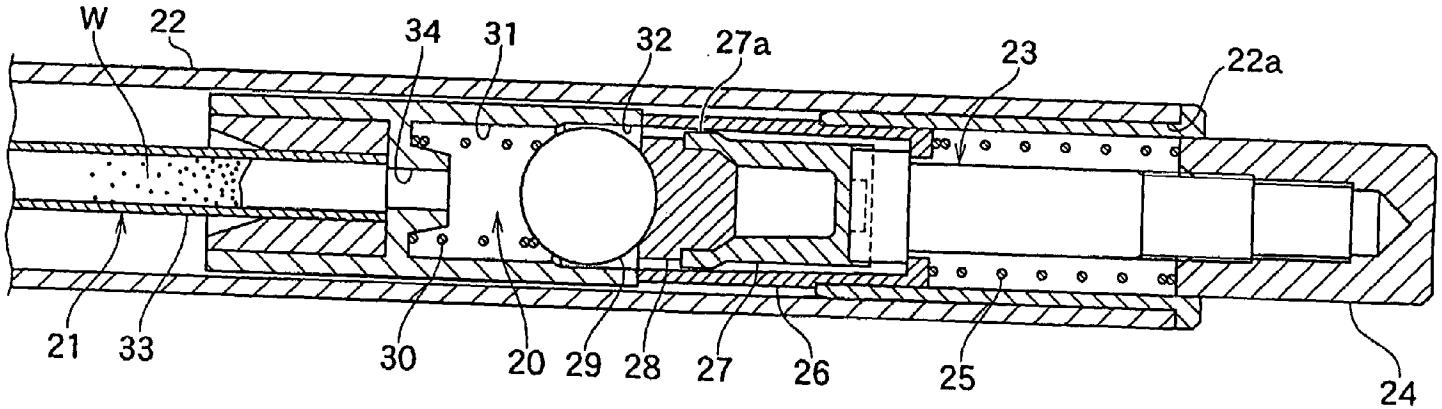
FIG. 5 is an enlarged cross sectional fragmentary view of a pressurization pen according to a second embodiment of the invention in a status when the pen is not in use.
Figure 6:
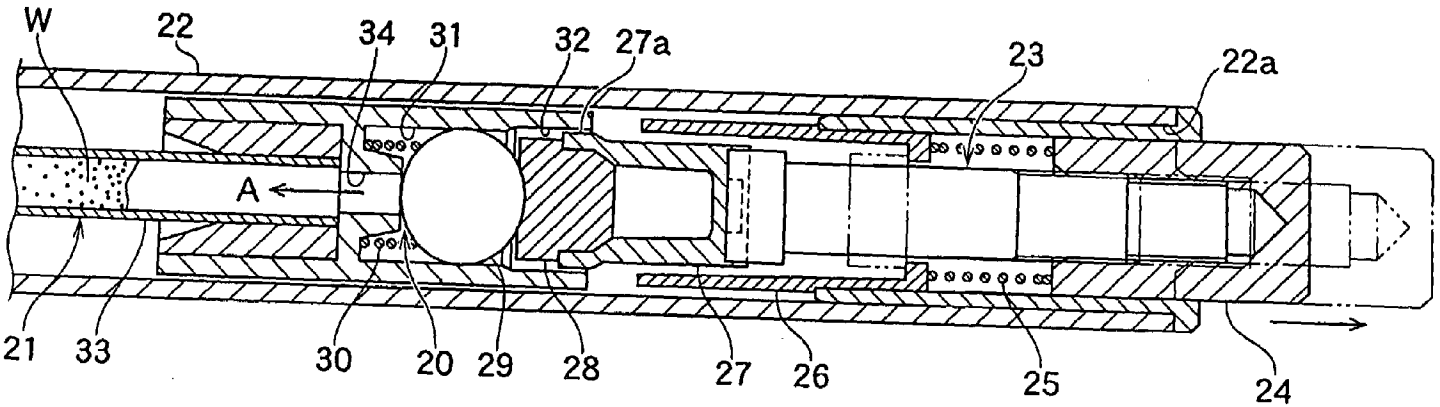
FIG. 6 is a view similar to FIG. 5 showing the pressurization pen according to the second embodiment of the invention in a status when the pen is in use.

FIGS. 5 and 6 are enlarged cross sectional views of main parts of a second embodiment of the invention. This embodiment has a pressurizing pump mechanism 20 incorporated in a knock type ballpoint pen. The knock type ballpoint pen has a known knock mechanism with which a pen tip (not shown) of a pen refill unit 21 can be projected and retracted, and the detailed explanation thereof will be omitted.

As shown in FIG. 5, a knock mechanism 23 is provided in a rear end opening 22*a* of an axial housing 22. The knock mechanism 23 is a known mechanism in which a knock stem 24 provided in the rear end opening 22*a* of the axial housing 22 performs push and release operations against the urging force of a compression spring 25 to drive a rotator 27 by a cam mechanism 26, so that the pen tip of the pen refill unit 21 can be projected to protruded state and retracted to the accommodated state.

A pressing chess-piece body 28 corresponding to the pressing stem 18 of the pressurizing pump mechanism 10 in the first embodiment is fitted into a front end 27*a* of the rotator 27. The pressing chess-piece body 28 follows the driving of the rotator 27.

In a standby state of the knock stem 24 in a non-pressurized state when the pen is not used, the pen tip is in the accommodated state and the spherical body 29 is released from the a pressurizing chamber 31 against the urging force of a compression spring 30 to be positioned within a spherical body accommodating portion 32, so that the inside of an ink accommodating tube 33, a ventilation passage 34, the pressurizing chamber 31 and the spherical body accommodating portion 32 are in a state ventilating with an ambient air and the inside of the ink accommodating tube 33 is in a non-pressurized state.

As shown in FIG. 6, in pen use state, if the knock stem 24 is pushed toward the front against the urging force of the compression spring 25, the rotator 27 is driven towards the front by the cam mechanism 26. The pressing chess-piece body 28 which follows the driving of the rotator 27 moves towards the front and the spherical body 29 moves within the pressurizing chamber 31 while being deformed elastically against the urging force of the compression spring 30 to form the airtight state within the pressurizing chamber 31. An air A within the pressurizing chamber 31 is forcedly transported within the ink accommodating tube 33 through the ventilation passage 34 in accordance with the moved distance of the spherical body 29 as indicated by an arrow. Whereby, the pressurized state is formed within the ink accommodating tube 33 and since the elastic deformation of the spherical body 29 at that time is large, the pressurized amount is large and the pressurization efficiency can be increased.

Subsequently, if pushing of the knock stem 24 is released, only the knock stem 24 is returned to the rear by the urging force of the compression spring 25 as shown by two-dot chain line and the rotator 27 is latched at a driving position. Therefore, the pen tip maintains a protruded state and a state that the spherical body 29 is pushed into the pressurizing chamber 31 by the pressing chess-piece body 28 is maintained. Whereby, in pen use state, since the inside of the ink accommodating tube 33 can be always maintained in the pressurized state, the writing can be easily performed at a state that the pen tip is directed upwardly.

If the knock stem 24 is again pushed towards the front against the urging force of the compression spring 25 to operate the rotator 27, the latched state of the rotator 27 to the cam mechanism 26 is released. The knock stem 24 returns to the rear by the urging force of the compression spring 25 and the rotator 27 moves towards the rear together with the pressing chess-piece body 28 by the urging force of the compression spring 30 to be returned to an original position shown in FIG. 5. Simultaneously, the spherical body 29 is released from the inside of the pressurizing chamber 31 to be returned to the original position, the inside of the ink accommodating tube 33, the ventilation passage 34, the pressurizing chamber 31 and the spherical body accommodating portion 32 become again a state ventilating with an ambient air, and the pressurized state within the ink accommodating tube 33 is released.

The above description of preferred embodiments has been given by way of example. From the disclosure given, those skilled in the art will not only understand the present invention and the attendant advantages, but will also find apparent various changes and modifications to the structures disclosed. It is sought, therefore, to cover all such changes and modifications as fall within the spirit and scope of the invention, as defined by the appended claims, and equivalents thereof.

What is claimed is:

1. A pen adapted to be pressurized including:

an axial housing having front and rear ends;

a pen refill unit mounted within said axial housing and including a tube for accommodating a medium like ink etc. said tube having front and rear ends;

a pen tip provided at the front end of said tube and protruding to the outside from the front end of the axial housing in a fixed state, and a pressurizing pump mechanism provided at the rear end of said medium accommodating tube for pressurizing the inside thereof, said pressurizing pump mechanism including a pressurizing chamber communicating with the inside of the medium accommodating tube, an elastic body adapted to be pushed into the pressurizing chamber, an urging unit for urging said elastic body in a releasing direction to be released from within the pressurizing chamber, and a pressing unit for moving forcedly the elastic body in a direction opposite the releasing direction against the urging force of the urging unit for pushing said elastic body into the pressurizing chamber in an airtight state, whereby the inside of the medium accommodating tube being pressurized when said elastic body is pushed by an operation of the pressing unit into the pressurizing chamber against the urging force of the urging unit, and the elastic body is released from within the pressurizing chamber by the urging force of the urging unit in a pushing-release operation of the pressing unit to maintain the inside of the medium accommodating tube in a state ventilated with ambient air.

2. The pen adapted to be pressurized according to claim 1, wherein the elastic body is formed as a spherical body.

3. The pen adapted to be pressurized according to claim 1, and further including a cap adapted to be mounted in removable manner in a first position at the front end of the axial housing for protecting the pen tip of the pen refill unit, and at the rear end of the axial housing in a second position for pushing and holding the pressing unit, thereby maintaining the inside of the medium accommodating tube in a pressurized state.

4. A pen adapted to be pressurized including:

an axial housing having front and rear ends;

a pen refill unit mounted within said axial housing and including a tube for accommodating a medium like ink etc. said tube having front and rear ends;

a pen tip provided at the front end of said tube, a knock mechanism for projecting said pen tip to the outside of the axial housing and for retracting it into the axial housing, and a pressurizing pump mechanism provided at the rear end of said medium accommodating tube for pressurizing an inside of the medium accommodating tube, said pressurizing pump mechanism including a pressurizing chamber communicating with the inside of the medium accommodating tube, an elastic body adapted to be pushed into the pressurizing chamber, an urging unit for urging said elastic body in a releasing direction to be released from within the pressurizing chamber, and a pressing unit for moving forcedly the elastic body in a direction opposite the releasing direction against the urging force of the urging unit for pushing said elastic body into the pressurizing chamber in an airtight state, whereby the inside of the medium accommodating tube being pressurized when said elastic body is pushed by an operation of the pressing unit into the pressurizing chamber against the urging force of the urging unit, and the elastic body is released from within the pressurizing chamber by the urging force of the urging unit in a pushing-release operation of the pressing unit to maintain the inside of the medium accommodating tube in a state ventilated with ambient air.

5. The pen adapted to be pressurized according to claim 4, wherein the elastic body is formed as a spherical body.

6. The pen adapted to be pressurized according to claim 4, wherein said knock mechanism comprises a rotary member driven by a cam mechanism through the push and release operation of a knock stem for retracting and projecting said pen tip of the pen refill unit into or from the axial housing, respectively, in which the pressing unit is coupled to the rotary member to be pushed and held in the projected state of the pen tip to maintain the inside of the medium accommodating tube in a pressurized state, while in a retracted state of the pen tip, the inside of the medium accommodating tube is maintained in a state ventilated with ambient air.

7. A pen adapted to be pressurized including:

an axial housing having front and rear ends;

a pen refill unit mounted within said axial housing and including a tube for accommodating a medium like ink etc., said tube having front and rear ends;

a pen tip provided at the front end of said tube and protruding to the outside from the front end of the axial housing in a fixed state; and a pressurizing pump mechanism provided at the rear end of said medium accommodating tube for pressurizing the inside thereof;

wherein said pressurizing pump mechanism includes a pressurizing chamber communicating with the inside of the medium accommodating tube, an elastic body adapted to be pushed into the pressurizing chamber, an urging unit for urging said elastic body in a releasing direction to be released from within the pressurizing chamber, and a pressing unit for moving forcedly the elastic body in a direction opposite the releasing direction against the urging force of the urging unit for pushing said elastic body into the pressurizing chamber in an airtight state;

wherein the elastic body is formed as a spherical body;

wherein the inside of the medium accommodating tube is configured to be pressurized when said elastic body is pushed by an operation of the pressing unit into the pressurizing chamber against the urging force of the urging unit; and wherein the elastic body is configured to be released from within the pressurizing chamber by the urging force of the urging unit in a pushing-release operation of the pressing unit to maintain the inside of the medium accommodating tube in a state ventilated with ambient air.

8. A pen adapted to be pressurized including:

an axial housing having front and rear ends;

a pen refill unit mounted within said axial housing and including a tube for accommodating a medium like ink etc., said tube having front and rear ends;

a pen tip provided at the front end of said tube and protruding to the outside from the front end of the axial housing in a fixed state; and a pressurizing pump mechanism provided at the rear end of said medium accommodating tube for pressurizing the inside thereof wherein said pressurizing pump mechanism includes a pressurizing chamber communicating with the inside of the medium accommodating tube, an elastic body adapted to be pushed into the pressurizing chamber, an urging unit for urging said elastic body in a releasing direction to be released from within the pressurizing chamber, and a pressing unit for moving forcedly the elastic body in a direction opposite the releasing direction against the urging force of the urging unit for pushing said elastic body into the pressurizing chamber in an airtight state;

a cap adapted to be mounted in removable manner in a first position at the front end of the axial housing for protecting the pen tip of the pen refill unit, and at the rear end of the axial housing in a second position for pushing and holding the pressing unit, thereby maintaining the inside of the medium accommodating tube in a pressurized state;

wherein the inside of the medium accommodating tube is configured to be pressurized when said elastic body is pushed by an operation of the pressing unit into the pressurizing chamber against the urging force of the urging unit; and wherein the elastic body is configured to be released from within the pressurizing chamber by the urging force of the urging unit in a pushing-release operation of the pressing unit to maintain the inside of the medium accommodating tube in a state ventilated with ambient air.

9. A pen adapted to be pressurized including:

an axial housing having front and rear ends;

a pen refill unit mounted within said axial housing and including a tube for accommodating a medium like ink etc., said tube having front and rear ends;

a pen tip provided at the front end of said tube;

a knock mechanism for projecting said pen tip to the outside of the axial housing and for retracting it into the axial housing; and a pressurizing pump mechanism provided at the rear end of said medium accommodating tube for pressurizing an inside of the medium accommodating tube;

wherein said pressurizing pump mechanism includes a pressurizing chamber communicating with the inside of the medium accommodating tube, an elastic body adapted to be pushed into the pressurizing chamber, an urging unit for urging said elastic body in a releasing direction to be released from within the pressurizing chamber, and a pressing unit for moving forcedly the elastic body in a direction opposite the releasing direction against the urging force of the urging unit for pushing said elastic body into the pressurizing chamber in an airtight state;

wherein the elastic body is formed as a spherical body;

wherein the inside of the medium accommodating tube is configured to be pressurized when said elastic body is pushed by an operation of the pressing unit into the pressurizing chamber against the urging force of the urging unit; and wherein the elastic body is configured to be released from within the pressurizing chamber by the urging force of the urging unit in a pushing-release operation of the pressing unit to maintain the inside of the medium accommodating tube in a state ventilated with ambient air.

* * * * *